United States Patent [19]

Nicklas et al.

[11] 4,232,064

[45] Nov. 4, 1980

[54] METHOD FOR MELTING AND APPLYING A FUSION ADHESIVE

[75] Inventors: Walter Nicklas, Nuertingen-Oberensingen; Dietrich Hesler, Frickenhausen; Gerhard Gresser, Oberboihingen, all of Fed. Rep. of Germany

[73] Assignee: Firma Karl M. Reich Maschinenfabrik GmbH, Nuertingen, Fed. Rep. of Germany

[21] Appl. No.: 967,105

[22] Filed: Dec. 7, 1978

Related U.S. Application Data

[62] Division of Ser. No. 918,570, Jun. 23, 1978, Pat. No. 4,178,876.

[30] Foreign Application Priority Data

Jul. 14, 1977 [DE] Fed. Rep. of Germany ..... 2731799

[51] Int. Cl.[2] ..... B05D 5/10

[52] U.S. Cl. ..... 427/208.4; 118/411; 118/666; 118/681; 219/421; 222/146 HE; 427/284

[58] Field of Search ..... 118/2, 5, 8, 411, 681, 118/410, 666, 202; 222/325, 327, 146 H, 146 HE; 219/421, 230; 228/52, 53; 427/207 R, 284

[56] References Cited

U.S. PATENT DOCUMENTS

| | | | |
|---|---|---|---|
| 3,682,456 | 8/1972 | Berczynski | 266/273 |
| 3,877,610 | 4/1975 | Dickey | 222/146 HE |
| 3,952,921 | 4/1976 | Tanner | 222/146 HE |
| 3,960,296 | 6/1976 | Nord | 222/146 HE |
| 4,033,484 | 7/1977 | Ornsteen | 222/146 HE |
| 4,060,180 | 11/1977 | Wieland | 222/146 HE |
| 4,144,913 | 3/1979 | Akes et al. | 222/146 HE |

FOREIGN PATENT DOCUMENTS 1305473 1/1973 United Kingdom .

*Primary Examiner*—John D. Smith
*Assistant Examiner*—S. L. Childs
*Attorney, Agent, or Firm*—W. G. Fasse; D. F. Gould

[57] ABSTRACT

A portion of a melting or fusing adhesive in the form of a cartridge is melted in a melting chamber and supplied under pressure to an adhesive applying device. The latter includes a melting chamber with a heated facing wall having exit holes therein through which the molten adhesive may be pressed out by a piston movable in the melting chamber by way of a power drive. The starting and stopping of the adhesive supply is controlled by the movement of a work piece past the adhesive applying device.

4 Claims, 4 Drawing Figures

METHOD FOR MELTING AND APPLYING A FUSION ADHESIVE

CROSS REFERENCE TO RELATED DISCLOSURE

This is a divisional of application Ser. No. 918,570; filed: June 23, 1978, U.S. Pat. No. 4,178,876.

BACKGROUND OF THE INVENTION

The invention relates to a method for melting a fusion adhesive, particularly for edge-gluing machines. In such machines it is known to completely melt a specific amount of fusion adhesive in the form of granules in a melting vessel and to supply the molten fusion adhesive by means of a feed screw or a supply piston to the applicator device for the fusion adhesive. The applicator device can be constructed either as a heatable application roller or as a heatable wedge-shaped nozzle element. Any surplus fusion adhesive which is not applied to the surfaces which are to be bonded, has to be returned again into the melting vessel.

Thus, when starting the edge-gluing machine for the known process, it is first necessary that all of the fusion adhesive which is located in the melting vessel, is melted, whereby a relatively long heating-up time must be taken into account. If the production process requires that the type of fusion adhesive be changed, for example, when a different quality or color of fusion adhesive is required, then a long preparation period is required for changing the types of fusion adhesive in the melting vessel.

A further disadvantage of the known process is seen in the cracking of the fusion adhesive by over-heating, which naturally has a bad effect on the quality of the bond. In addition, gas bubbles and vapor may form in the melting vessel, which is unpleasant for the operator and, under certain circumstances, effects which are detrimental to health may occur.

OBJECTS OF THE INVENTION

In view of the foregoing, it is the aim of the invention to achieve the following objects singly or in combination.

to provide a method which makes it possible, particularly in connection with edge-gluing machines, to quickly melt just the quantity of fusion adhesive required for the bonding in the shortest possible time;

to provide for a rapid changing of the type of fusion adhesive;

to reduce the production costs;

to minimize the costs of the energy required for the melting;

to reduce the necessary set-up time for an adhesive applicator;

to avoid cracking of the adhesive by eliminating overheating;

SUMMARY OF THE INVENTION

According to the invention the present method is performed in that a portion of a fusion adhesive unit is melted in a melting chamber and is supplied under pressure to the application device for the fusion adhesive.

This method has the advantage that only as much fusion adhesive as is required for a satifactory function of the applicator is melted at any one time. Due to the short melting time thus made possible when the edge-gluing machine is started up, a reduction in the production times and thus an important cost reduction has been achieved. These advantages are also obtained when changing the type of fusion adhesive, since the fusion adhesive unit located in the melting chamber only has to be changed.

The melting of a relatively small amount of fusion adhesive prevents the cracking of the fusion adhesive, so that satisfactory bonding is ensured. In addition, the formation of gases and vapors and thus annoyance to the operator is greatly reduced. Hence, the process according to the invention is terefore environmentally acceptable.

A larger quantity of fusion adhesive may be processed, according to the invention, if the fusion adhesive unit is supplied to the melting chamber from a magazine, if said unit of adhesive is pressed by a power-operated feed device toward a heatable melting wall, if the area of the adhesive unit which rests against the melting wall is melted, and if the molten fusion adhesive is supplied under pressure to the applicator device. These steps have the further advantage that at any given time only the quantity of fusion adhesive which is absolutely essential, is melted. When the type of fusion adhesive needs to be changed, the units of fusion adhesive in the magazine may easily be exchanged.

The present method may be performed by an apparatus in which the melting chamber has a heatable melting wall at one end and outlet apertures in said melting wall for the molten fusion adhesive, and wherein a supply piston is movably mounted in the melting chamber, said supply piston being movable by means of a feed advance unit.

This apparatus is simple and cheap to produce, and since there is no driven feed screw, an electromotor is not required. A further saving is made in the amount of energy required for melting a specific amount of fusion adhesive, since only the melting wall has to be heated and not the entire chamber.

If, according to the invention the cylinder wall of the melting chamber is made at least in part of a material with a low thermal conductivity, then it is ensured in an advantageous manner that the heat from the melting wall acts only on the area of the fusion adhesive which rests directly against it, and not on the areas of the adhesive lying further away. These areas, therefore, remain in the solid state. Furthermore, the cylinder wall of the melting chamber may be provided with a coating of non-sticking material such as Teflon (RTM), in the vicinity of the melting wall so that it is ensured that molten fusion adhesive does not adhere to the cylinder wall and the fusion adhesive unit may be removed easily from the melting chamber when the type of fusion adhesive is being changed.

Further advantageous embodiments of the invention are characterized in the dependent claims.

BRIEF FIGURE DESCRIPTION

In order that the invention may be clearly understood it will now be described, by way of example, with reference to the accompanying drawings, wherein.

DETAILED DESCRIPTION OF PREFERRED EXAMPLE EMBODIMENTS

Figure 1:
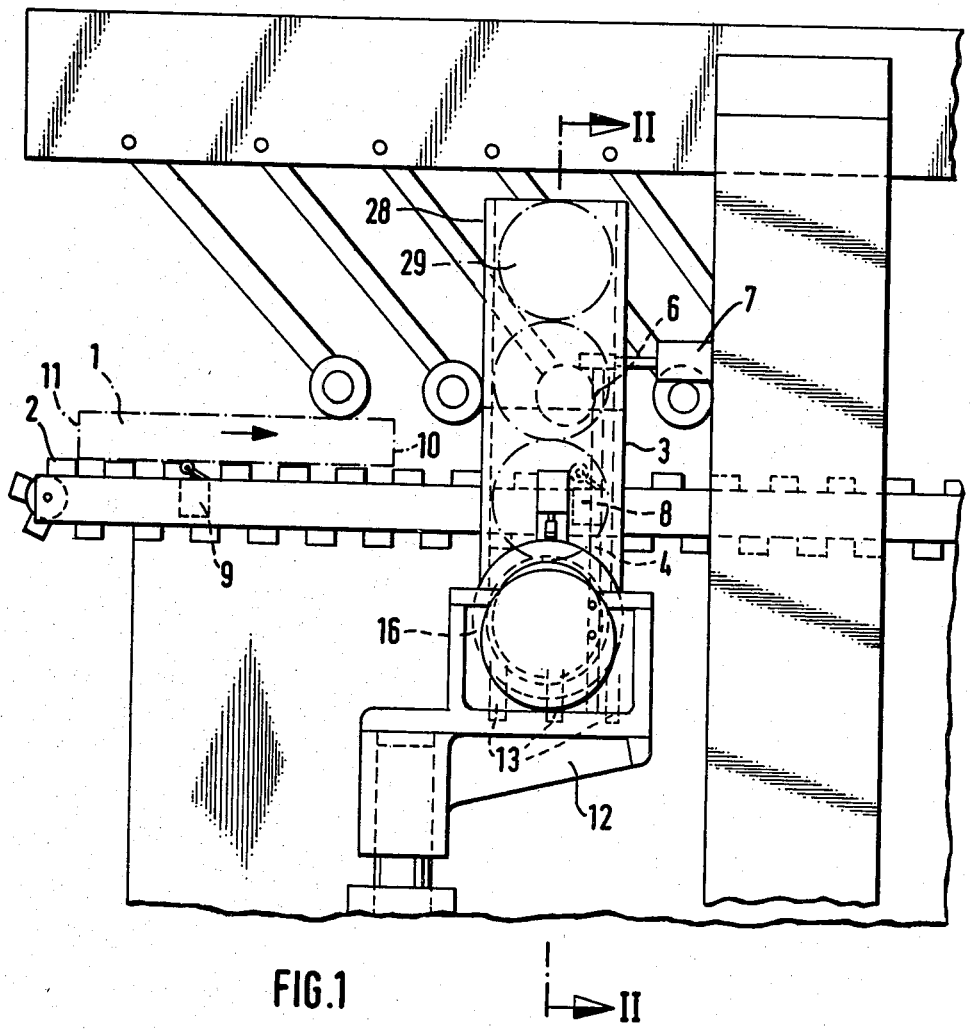
FIG. 1 shows a partial rear view of an edge-gluing machine with an adhesive melting applicator.
Figure 2:
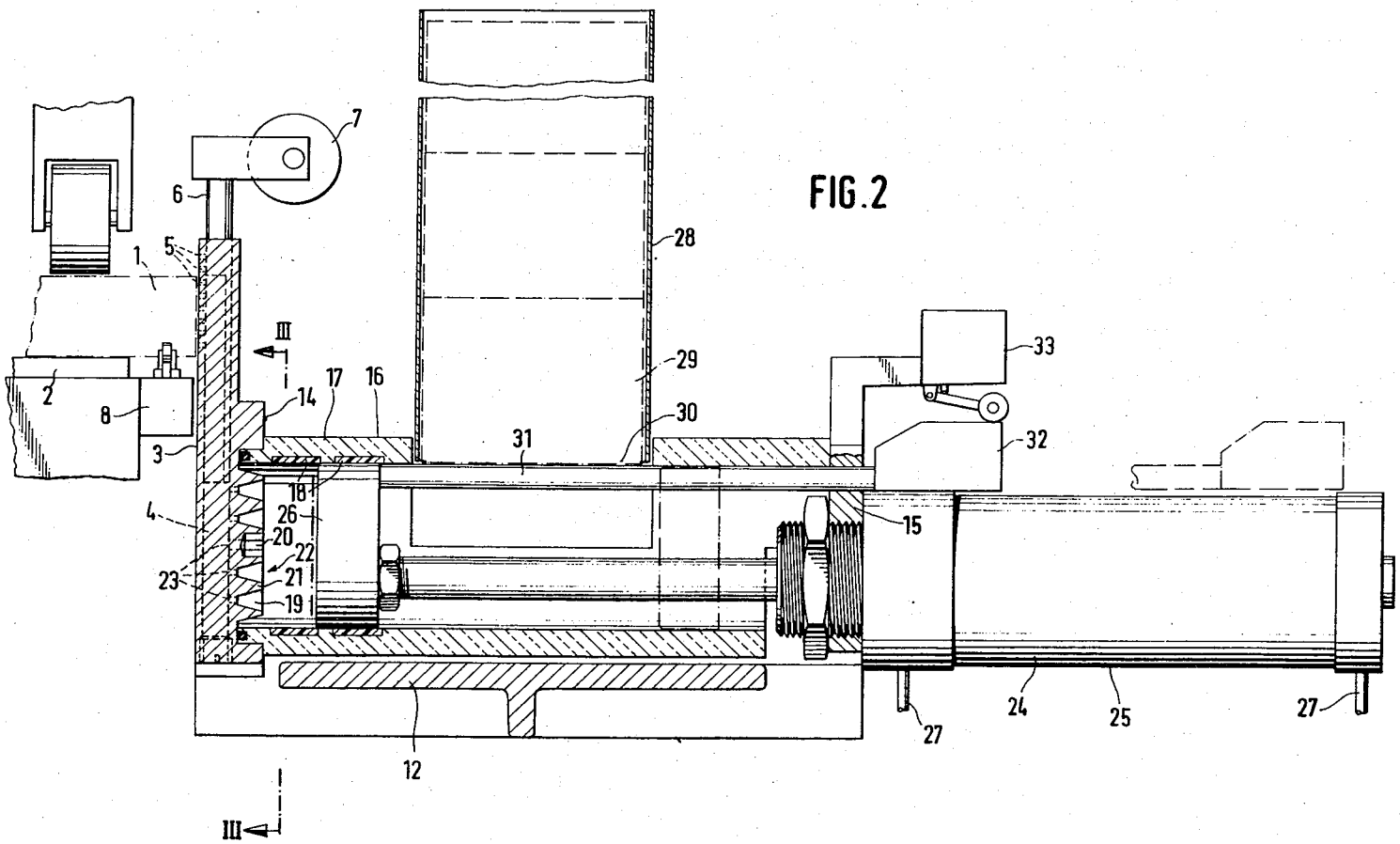
FIG. 2 is a section along line II—II in FIG. 1.

As FIG. 1 shows, a plate-shaped workpiece 1 is supplied in a known manner by means of a conveyor chain 2 to a wedge-shaped nozzle body 3 for providing the workpiece with liquid fusion adhesive on one lateral narrow face. Then the workpiece is bonded to an edge lip or backing, not shown. As is also shown in FIG. 2, for this purpose the wedge-shaped nozzle body 3 is equipped with an adhesive duct 4 and with nozzle holes 5 through which the adhesive reaches the lateral narrow face of the workpiece 1. A rotary slide valve 6 is rotatably mounted in the adhesive duct 4 for controlling the flow of adhesive. The valve 6 may be actuated by a cylinder-piston unit 7. The latter is controlled in turn by a first sensor valve 8 which is influenced by the leading edge 10 and the trailing edge 11 of the workpiece 1.

The nozzle body 3 is attached in a known manner to a bracket 12 which is pivotably mounted to the frame of the edge-gluing machine. Heating element 13 in the nozzle body 3 heat the nozzle body to a specific standby temperature, so that the fusion adhesive in the adhesive duct 4 is always molten. On the bracket 12, between a side face 14 of the nozzle body 3 and a transverse wall 15 there is arranged a melting chamber 16, the cylinder wall 17 of which is made, at least in the vicinity of the side face 14, of a material having low thermal conductivity, such as asbestos cement. The inner surface of the cylinder wall 17 may be partially covered with a coating 18 of a non-stick material such as fluorocarbon resin, for example.

Figure 3:
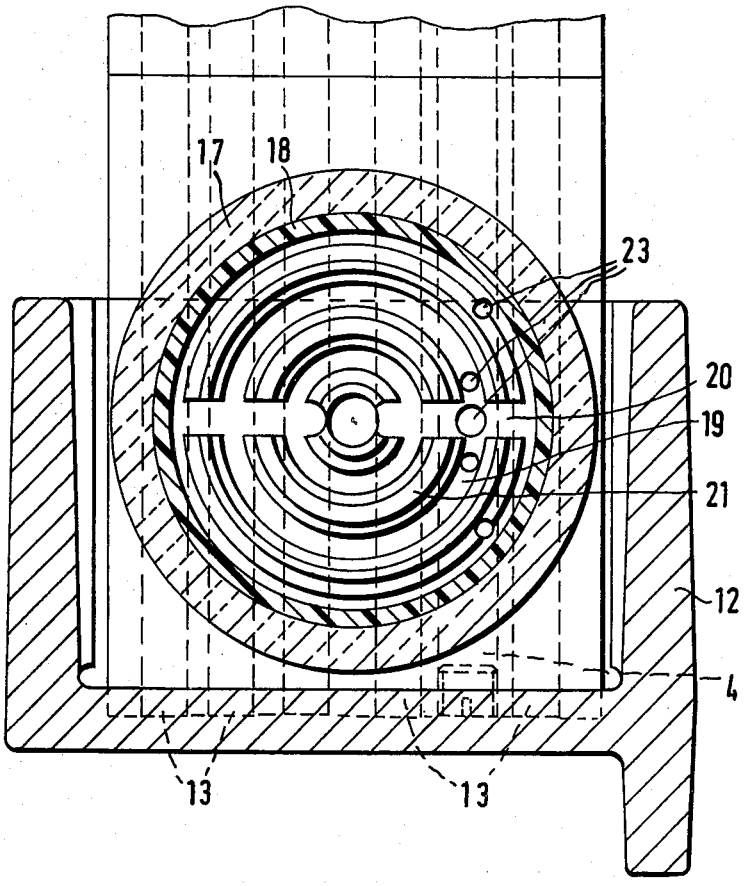
FIG. 3 is a section along line III—III in FIG. 2.

As FIGS. 2 and 3 show, the side face 14 of the nozzle body 3 is provided with concentric annular grooves 19 in the region of the melting chamber 16. The grooves 19 are interconnected by radial grooves 20. These annular grooves 19 form together with the annular ribs 21 between the grooves, a melting wall 22, which is connected in a thermally conducting manner with the heatable nozzle body 3. Outlet holes 23 lead from the space inside the melting chamber 16 through the melting wall 22 into the adhesive duct 4.

The cylinder 24 of a feed advance unit 25 operated by compressed air, is secured in the transverse wall 15. The supply piston 26 of the feed advance unit 25 is movably mounted in the melting chamber 16. The cylinder 24 is connected through ducts 27 to the first sensor valve 8 and to a second sensor valve 9.

A magazine 28 is also attached to the bracket 12, to accommodate individual cylindrical units 29 of fusion adhesive, which may reach the melting chamber 16 through a supply aperture 30. Due to the vertical arrangement of the magazine 28 in the present embodiment, the supply of the fusion adhesive units or cartridges 29 is achieved by gravity. However, it is also possible to arrange the magazine in any other position relative to the melting chamber 16, and to supply the fusion adhesive units 29 to the melting chamber 16 by means of an external force, such as a spring. In front of the supply aperture 30 a slide plate 31 is mounted to the supply piston 26 for shutting off the supply aperture 30 during the conveying stroke of the supply piston 26. On its free end the slide plate 31 has a cam 32 which co-acts with a third sensor valve 33 which serves for controlling the feed unit 25.

The apparatus according to the invention operates as follows. First, the magazine 28 is filled with fusion adhesive units or cartridges 29. Since the supply piston 26 is in the rest position shown by dashed lines in FIG. 2. A first fusion adhesive unit 29 may reach the melting chamber 16 through the supply aperture 30. If the leading edge 10 of the workpiece 1 now actuates the second sensor valve 9 it initiates the conveying stroke of the supply piston 26, so that the fusion adhesive unit 29 located in the melting chamber 16 is pressed against the heated melting wall 22. At the same time the heating elements 13 are switched to a higher working temperature by the second sensor valve 9, so that the quantity of fusion adhesive required for the application process is positively melted. Both the static or constant temperature and the working temperature are held at the respective desired levels by adjustable temperature sensors. The area of the fusion adhesive unit 29 which is resting against the melting wall 22 is melted, and the supply piston 26 forces the melted fusion adhesive into the adhesive duct 4.

If the leading edge 10 of the workpiece 1 now actuates the first sensor valve 8 it acts on the rotary slide valve 6 through the cylinder-piston unit 7, and the molten fusion adhesive reaches the lateral narrow face of the workpiece 1 through the nozzles holes 5. However, after it has been actuated, the first sensor valve 8 simultaneously causes the loading of the feed advance unit 25 with compressed air thereby maintaining the pressure on the supply piston 26 in the direction toward the melting wall 22.

When the trailing edge 11 of the workpiece 1 clears the second sensor valve 9 it switches the heating elements 13 back again to their static temperature. When the trailing edge 11 subsequently clears the first sensor valve 8, it terminates the conveying stroke of the supply piston 26, which, however, remains in the stroke position it has reached, wherein it is not loaded with compressed air. At the same time, the rotary slide valve 6 is swung back into its closed position so that the nozzle holes 5 are closed again.

This process is repeated everytime a workpiece 1 actuates the first and second sensor valves. When a fusion adhesive unit 29 is approximately consumed halfway, a cam 32 actuates the third sensor valve 33. This third sensor valve causes the return stroke of the supply piston 26, which is released, however, only after the trailing edge 11 of the workpiece 1 has cleared the first sensor valve 8. This feature ensures that the return stroke of the supply piston 26 takes place only when there is no workpiece 1 in the vicinity of the nozzle holes 5. The slide plate 31 connected to the supply piston 26 now moves away from the supply aperture 30 and the next fusion adhesive unit 29 may enter the melting chamber 16.

In order to ensure that in fact only the portion of the fusion adhesive unit 29 in the vicinity of the melting wall 22 is melted, the cylinder wall 17 may be provided in an area which adjoins the melting zone in the proximity of the melting wall 22, with an annular duct which may be loaded with small amounts of compressed air so that the rest of the fusion adhesive unit 29 remains cool. By using a material with low thermal conductivity for the cylinder wall 17 it is also ensured that no heat can reach the parts of the fusion adhesive unit 29 away from the melting wall 22 through the cylinder wall 17. For this purpose it is sufficient if the cylinder wall 17 is made of a material with a low thermal conductivity only near the melting wall 22. The rest of the cylinder wall 17 may be made of any kind of suitable material.

The coating 18 of non-stick material with which the inner surface of the cylinder wall 17 may be covered, prevents the molten fusion adhesive from sticking to the cylinder wall 17. Thus, if the type of fusion adhesive is to be changed, it is quite simple to take out the remainder of the fusion adhesive unit 29 which is located in the melting chamber 17.

In order to prevent the fusion adhesive unit 29 from being melted unnecessarily during long breaks in operation, a time relay may also be provided, to switch the heating elements 13 off after a specific period of time. The operator must switch on the heating elements 13 before inserting the next workpiece 1.

The consumption of fusion adhesive may be adjusted by varying the force acting on the fusion adhesive unit 29 from the supply piston 26, or by selecting different diameter fusion adhesive units 29.

Figure 4:
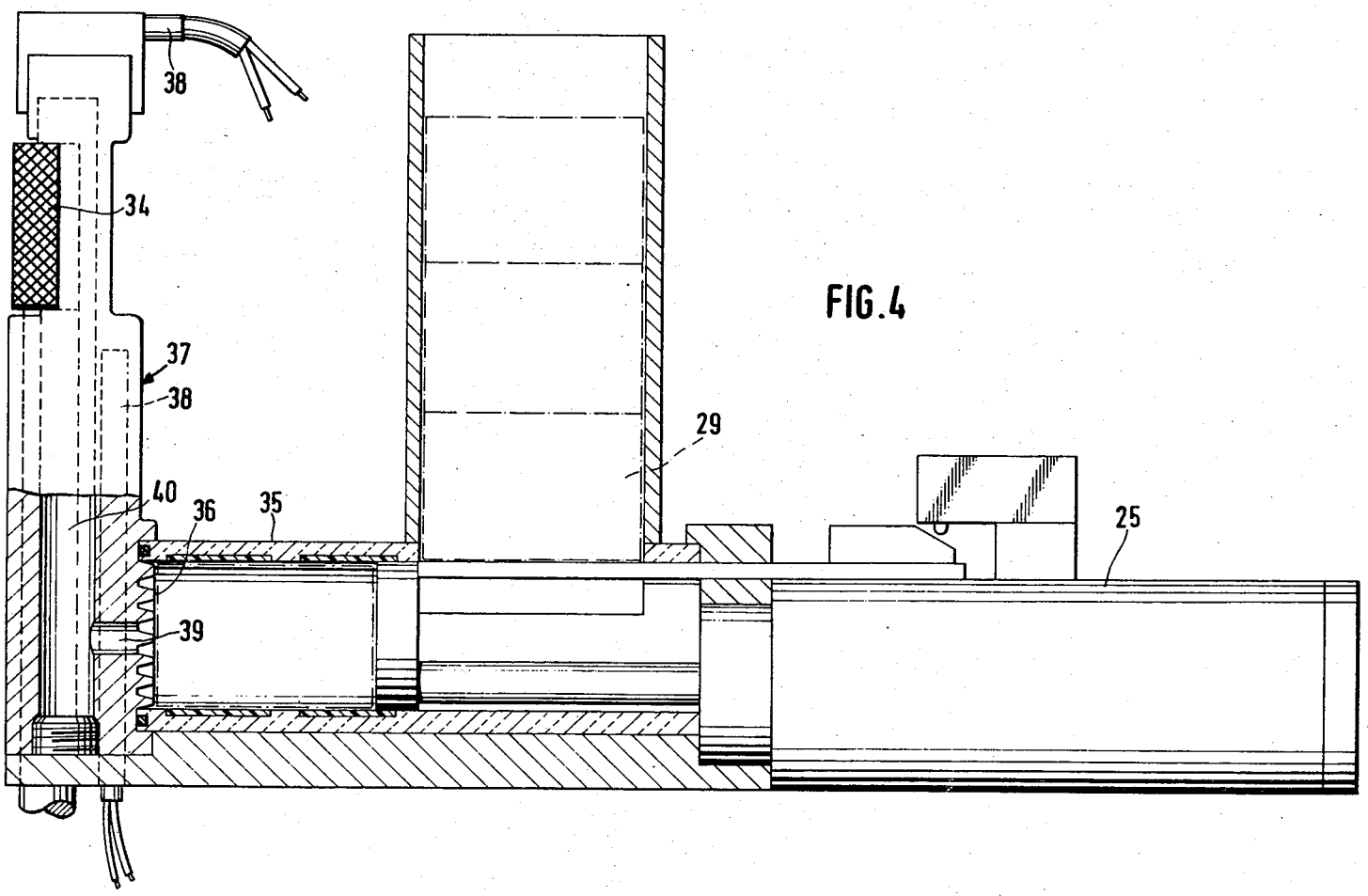
FIG. 4 shows an adhesive melting roller applicator partially in section.

The process according to the invention and the present apparatus may also be used in conjunction with an applicator device with an application roller 34 for applying fusion adhesive. In this embodiment, shown in FIG. 4, the melting chamber 35 and the melting wall 36 are connected to an applicator device 37 which may be heated by heating elements 38. A supply duct 40 leads from the outlet hole 39 in the melting wall 35 to the applicator roller 34.

The melting apparatus according to the invention may also be arranged separate from the applicator device, whereby the melting chamber and the heatable melting wall form a unit and whereby the molten fusion adhesive is supplied to the applicator device through a heatable supply duct.

It is also possible to supply specific amounts of fusion adhesive to the melting chamber in the form of granules instead of individual fusion adhesive units or cartridges.

Although the invention has been described with reference to specific example embodiments, it is to be understood, that it is intended to cover all modifications and equivalents within the scope of the appended claims.

What is claimed is:

1. A method for melting and applying fusion adhesive to a work piece in a gluing machine, comprising the steps of: supplying the fusion adhesive from a magazine into a melting chamber, pressing said fusion adhesive by power operated feed advance means in the direction and against a heatable melting wall, melting only a zone of the fusion adhesive which rests against said melting wall, supplying the molten adhesive under pressure to an applicator device, and initiating the operation of said feed advance means for the fusion adhesive in response to the movement of said work piece through the gluing machine.

2. The method of claim 1, wherein said initiating step begins a conveying stroke of the feed advance means in response to a leading edge of a work piece which actuates sensor valve means, said method further comprising maintaining said conveying stroke by actuation of further sensor valve means by said leading edge, and terminating the conveying stroke when the trailing edge of the work piece clears the further sensor valve.

3. The method of claim 2, further comprising actuating a third sensor valve by means of the feed advance unit for initiating the return stroke of the power operated feed advance means after said further sensor valve has been released by the trailing edge of the work piece.

4. The method of claim 2 or 3, comprising the further step of switching heating elements for said heatable melting wall, after actuation of said first mentioned sensor valve from a stand-by temperature to a higher working temperature, and then switching the heating elements back to their rest temperature after release of said first mentioned sensor valve by the trailing edge of the work piece.

* * * * *